US007045704B2

(12) United States Patent
Areskoug

(10) Patent No.: US 7,045,704 B2
(45) Date of Patent: May 16, 2006

(54) STATIONARY INDUCTION MACHINE AND A CABLE THEREFOR

(75) Inventor: Claes Areskoug, Ludvika (SE)

(73) Assignee: ABB AB, Vasteras (SE)

( * ) Notice: Subject to any disclaimer, the term of this patent is extended or adjusted under 35 U.S.C. 154(b) by 55 days.

(21) Appl. No.: 10/258,740

(22) PCT Filed: Apr. 19, 2001

(86) PCT No.: PCT/SE01/00855

§ 371 (c)(1),
(2), (4) Date: Apr. 14, 2003

(87) PCT Pub. No.: WO01/84571

PCT Pub. Date: Nov. 5, 2001

(65) Prior Publication Data

US 2003/0164245 A1 Sep. 4, 2003

(30) Foreign Application Priority Data

Apr. 28, 2000 (SE) ..... 0001589

(51) Int. Cl.
*H01B 9/06* (2006.01)

(52) U.S. Cl. ..... 174/15.1

(58) Field of Classification Search ..... 174/15.1, 174/47, 15.7, 15.6; 219/677
See application file for complete search history.

(56) References Cited

U.S. PATENT DOCUMENTS

| | | | |
|---|---|---|---|
| 681,800 | A | 9/1901 | Lasche |
| 847,008 | A | 3/1907 | Kitsee |
| 1,304,451 | A | 5/1919 | Burnham |
| 1,418,856 | A | 6/1922 | Williamson |

(Continued)

FOREIGN PATENT DOCUMENTS

| | | |
|---|---|---|
| AT | 399790 | 7/1995 |
| BE | 565063 | 2/1957 |
| CH | 391071 | 4/1965 |
| CH | SU 266037 | 10/1965 |
| CH | 534448 | 2/1973 |

(Continued)

OTHER PUBLICATIONS

Shipboard Electrical Insulation; G. L. Moses, 1951, pp2&3.

ABB Elkrafthandbok; ABB AB; 1988 ; pp274–276.

Elkraft teknisk Handbok, 2 Elmaskiner; A. Alfredsson et al; 1988, pp 121–123.

High Voltage Cables in a New Class of Generators Powerformer; M. Leijon et al; Jun. 14, 1999; pp1–8.

Ohne Tranformator direkt ins Netz; Owman et al, ABB, AB; Feb. 8, 1999; pp48–51.

Submersible Motors and Wet–Rotor Motors for Centrifugal Pumps Submerged in the Fluid Handled; K.. Bienick, KSB; Feb. 25, 1988; pp9–17.

High Voltage Generators; G. Beschasinov et al; 1977; vol. 48. No. 6 pp1–7.

(Continued)

*Primary Examiner*—Chau N. Nguyen
(74) *Attorney, Agent, or Firm*—Oblon, Spivak, McClelland, Maier & Neustadt, P.C.

(57) ABSTRACT

A stationary induction machine, and a cable for such an induction machine, including a winding including an elongate, flexible cable, having an electric lead, and a cooling device, arranged, with the aid of a coolant, to divert excess heat generated in the lead during operation of the induction machine. The lead is in a form of a tube and surrounds a continuous channel for circulation of the coolant. The cable includes a cooling tube of a polymer material that is arranged in the lead and forms the channel.

11 Claims, 3 Drawing Sheets

U.S. PATENT DOCUMENTS

| | | | | | |
|---|---|---|---|---|---|
| 1,481,585 | A | | 1/1924 | Beard | |
| 1,508,456 | A | | 9/1924 | Lenz | |
| 1,728,915 | A | | 9/1929 | Blankenship et al. | |
| 1,742,985 | A | | 1/1930 | Burnham | |
| 1,747,507 | A | | 2/1930 | George | |
| 1,756,672 | A | | 4/1930 | Barr | |
| 1,762,775 | A | | 6/1930 | Ganz | |
| 1,781,308 | A | | 11/1930 | Vos | |
| 1,861,182 | A | | 5/1932 | Hendey et al. | |
| 1,904,885 | A | | 4/1933 | Seeley | |
| 1,974,406 | A | | 9/1934 | Apple et al. | |
| 2,006,170 | A | | 6/1935 | Juhlin | |
| 2,206,856 | A | | 7/1940 | Shearer | |
| 2,217,430 | A | | 10/1940 | Baudry | |
| 2,241,832 | A | | 5/1941 | Wahlquist | |
| 2,251,291 | A | | 8/1941 | Reichelt | |
| 2,256,897 | A | | 9/1941 | Davidson et al. | |
| 2,295,415 | A | | 9/1942 | Monroe | |
| 2,409,893 | A | | 10/1946 | Pendleton et al. | |
| 2,415,652 | A | | 2/1947 | Norton | |
| 2,424,443 | A | | 7/1947 | Evans | |
| 2,436,306 | A | | 2/1948 | Johnson | |
| 2,446,999 | A | | 8/1948 | Camilli | |
| 2,459,322 | A | | 1/1949 | Johnston | |
| 2,462,651 | A | | 2/1949 | Lord | |
| 2,498,238 | A | | 2/1950 | Berberich et al. | |
| 2,650,350 | A | | 8/1953 | Heath | |
| 2,721,905 | A | | 10/1955 | Monroe | |
| 2,749,456 | A | | 6/1956 | Luenberger | |
| 2,780,771 | A | | 2/1957 | Lee | |
| 2,846,599 | A | | 8/1958 | McAdam | |
| 2,885,581 | A | | 5/1959 | Pileggi | |
| 2,943,242 | A | | 6/1960 | Schaschi et al. | |
| 2,947,957 | A | | 8/1960 | Spindler | |
| 2,959,699 | A | | 11/1960 | Smith et al. | |
| 2,962,679 | A | | 11/1960 | Stratton | |
| 2,975,309 | A | | 3/1961 | Seidner | |
| 3,014,139 | A | | 12/1961 | Shildneck | |
| 3,098,893 | A | | 7/1963 | Pringle et al. | |
| 3,130,335 | A | | 4/1964 | Rejda | |
| 3,143,269 | A | | 8/1964 | Van Eldik | |
| 3,157,806 | A | | 11/1964 | Wiedemann | |
| 3,158,770 | A | | 11/1964 | Coggeshall et al. | |
| 3,197,723 | A | | 7/1965 | Dortort | |
| 3,268,766 | A | | 8/1966 | Amos | |
| 3,304,599 | A | | 2/1967 | Nordin | |
| 3,354,331 | A | | 11/1967 | Broeker et al. | |
| 3,365,657 | A | | 1/1968 | Webb | |
| 3,372,283 | A | | 3/1968 | Jaecklin | |
| 3,392,779 | A | | 7/1968 | Tilbrook | |
| 3,400,737 | A | * | 9/1968 | Matthews et al. | 138/111 |
| 3,411,027 | A | | 11/1968 | Rosenberg | |
| 3,418,530 | A | | 12/1968 | Cheever | |
| 3,435,262 | A | | 3/1969 | Bennett et al. | |
| 3,437,858 | A | | 4/1969 | White | |
| 3,444,407 | A | | 5/1969 | Yates | |
| 3,447,002 | A | | 5/1969 | Ronnevig | |
| 3,484,690 | A | | 12/1969 | Wald | |
| 3,541,221 | A | | 11/1970 | Aupoix et al. | |
| 3,560,777 | A | | 2/1971 | Moeller | |
| 3,571,690 | A | | 3/1971 | Lataisa | |
| 3,593,123 | A | | 7/1971 | Williamson | |
| 3,631,519 | A | | 12/1971 | Salahshourian | |
| 3,644,662 | A | | 2/1972 | Salahshourian | |
| 3,651,244 | A | | 3/1972 | Silver et al. | |
| 3,651,402 | A | | 3/1972 | Leffmann | |
| 3,660,721 | A | | 5/1972 | Baird | |
| 3,666,876 | A | | 5/1972 | Forster | |
| 3,670,192 | A | | 6/1972 | Andersson et al. | |
| 3,675,056 | A | | 7/1972 | Lenz | |
| 3,684,821 | A | | 8/1972 | Miyauchi et al. | |
| 3,684,906 | A | | 8/1972 | Lexz | |
| 3,699,238 | A | | 10/1972 | Hansen et al. | |
| 3,716,652 | A | | 2/1973 | Lusk et al. | |
| 3,716,719 | A | | 2/1973 | Angelery et al. | |
| 3,727,085 | A | | 4/1973 | Goetz et al. | |
| 3,740,600 | A | | 6/1973 | Turley | |
| 3,743,867 | A | | 7/1973 | Smith, Jr. | |
| 3,746,954 | A | | 7/1973 | Myles et al. | |
| 3,758,699 | A | | 9/1973 | Lusk et al. | |
| 3,778,891 | A | | 12/1973 | Amasino et al. | |
| 3,781,739 | A | | 12/1973 | Meyer | |
| 3,787,607 | A | | 1/1974 | Schlafly | |
| 3,792,399 | A | | 2/1974 | McLyman | |
| 3,800,362 | A | * | 4/1974 | Wilson | 425/556 |
| 3,801,843 | A | | 4/1974 | Corman et al. | |
| 3,809,933 | A | | 5/1974 | Sugawara et al. | |
| 3,813,764 | A | | 6/1974 | Tanaka et al. | |
| 3,820,048 | A | | 6/1974 | Ohta et al. | |
| 3,828,115 | A | | 8/1974 | Hvizd, Jr. | |
| 3,881,647 | A | | 5/1975 | Wolfe | |
| 3,884,154 | A | | 5/1975 | Marten | |
| 3,891,880 | A | | 6/1975 | Britsch | |
| 3,902,000 | A | | 8/1975 | Forsyth et al. | |
| 3,912,957 | A | | 10/1975 | Reynolds | |
| 3,932,779 | A | | 1/1976 | Madsen | |
| 3,932,791 | A | | 1/1976 | Oswald | |
| 3,943,392 | A | | 3/1976 | Keuper et al. | |
| 3,947,278 | A | | 3/1976 | Youtsey | |
| 3,965,408 | A | | 6/1976 | Higuchi et al. | |
| 3,968,388 | A | | 7/1976 | Lambrecht et al. | |
| 3,971,543 | A | | 7/1976 | Shanahan | |
| 3,974,314 | A | | 8/1976 | Fuchs | |
| 3,993,860 | A | | 11/1976 | Snow et al. | |
| 3,995,785 | A | | 12/1976 | Arick et al. | |
| 4,001,616 | A | | 1/1977 | Lonseth et al. | |
| 4,008,367 | A | | 2/1977 | Sunderhauf | |
| 4,008,409 | A | | 2/1977 | Rhudy et al. | |
| 4,031,310 | A | | 6/1977 | Jachimowicz | |
| 4,039,740 | A | | 8/1977 | Iwata | |
| 4,041,431 | A | | 8/1977 | Enoksen | |
| 4,047,138 | A | | 9/1977 | Steigerwald | |
| 4,064,419 | A | | 12/1977 | Peterson | |
| 4,084,307 | A | | 4/1978 | Schultz et al. | |
| 4,085,347 | A | | 4/1978 | Lichius | |
| 4,088,953 | A | | 5/1978 | Sarian | |
| 4,091,138 | A | | 5/1978 | Takagi et al. | |
| 4,091,139 | A | | 5/1978 | Quirk | |
| 4,099,227 | A | | 7/1978 | Liptak | |
| 4,103,075 | A | | 7/1978 | Adam | |
| 4,106,069 | A | | 8/1978 | Trautner et al. | |
| 4,107,092 | A | | 8/1978 | Carnahan et al. | |
| 4,109,098 | A | | 8/1978 | Olsson et al. | |
| 4,121,148 | A | | 10/1978 | Platzer | |
| 4,132,914 | A | | 1/1979 | Khutoretsky | |
| 4,134,036 | A | | 1/1979 | Curtiss | |
| 4,134,055 | A | | 1/1979 | Akamatsu | |
| 4,134,146 | A | | 1/1979 | Stetson | |
| 4,149,101 | A | | 4/1979 | Lesokhin et al. | |
| 4,152,615 | A | | 5/1979 | Calfo et al. | |
| 4,160,193 | A | | 7/1979 | Richmond | |
| 4,164,672 | A | | 8/1979 | Flick | |
| 4,164,772 | A | | 8/1979 | Hingorani | |
| 4,177,397 | A | | 12/1979 | Lill | |
| 4,177,418 | A | | 12/1979 | Brueckner et al. | |
| 4,184,186 | A | | 1/1980 | Barkan | |
| 4,200,817 | A | | 4/1980 | Bratoljic | |
| 4,200,818 | A | | 4/1980 | Ruffing et al. | |
| 4,206,434 | A | | 6/1980 | Hase | |
| 4,207,427 | A | | 6/1980 | Beretta et al. | |
| 4,207,482 | A | | 6/1980 | Neumeyer et al. | |

4,208,597 A 6/1980 Mulach et al.
4,229,721 A 10/1980 Koloczek et al.
4,238,339 A 12/1980 Khutoretsky et al.
4,239,999 A 12/1980 Vinokurov et al.
4,245,182 A 1/1981 Aotsu et al.
4,246,694 A 1/1981 Raschbichler et al.
4,255,684 A 3/1981 Mischler et al.
4,258,280 A 3/1981 Starcevic
4,262,209 A 4/1981 Berner
4,274,027 A 6/1981 Higuchi et al.
4,281,264 A 7/1981 Keim et al.
4,292,558 A 9/1981 Flick et al.
4,307,311 A 12/1981 Grozinger
4,308,476 A 12/1981 Schuler
4,308,575 A 12/1981 Mase
4,310,966 A 1/1982 Breitenbach
4,314,168 A 2/1982 Breitenbach
4,317,001 A 2/1982 Silver et al.
4,320,645 A 3/1982 Stanley
4,321,426 A 3/1982 Schaeffer
4,321,518 A 3/1982 Akamatsu
4,326,181 A 4/1982 Allen
4,330,726 A 5/1982 Albright et al.
4,337,922 A 7/1982 Streiff et al.
4,341,989 A 7/1982 Sandberg et al.
4,347,449 A 8/1982 Beau
4,347,454 A 8/1982 Gellert et al.
4,357,542 A 11/1982 Kirschbaum
4,360,748 A 11/1982 Raschbichler et al.
4,361,723 A 11/1982 Hvizd, Jr. et al.
4,363,612 A 12/1982 Walchhutter
4,364,418 A * 12/1982 Genini et al. ..... 138/103
4,365,178 A 12/1982 Lexz
4,367,425 A 1/1983 Mendelsohn et al.
4,367,890 A 1/1983 Spirk
4,368,418 A 1/1983 DeMello et al.
4,369,389 A 1/1983 Lambrecht
4,371,745 A 2/1983 Sakashita
4,384,944 A 5/1983 Silver et al.
4,387,316 A 6/1983 Katsekas
4,401,920 A 8/1983 Taylor et al.
4,403,163 A 9/1983 Armerding et al.
4,404,486 A 9/1983 Keim et al.
4,411,710 A 10/1983 Mochizuki et al.
4,421,284 A 12/1983 Pan
4,425,521 A 1/1984 Rosenberry, Jr. et al.
4,426,771 A 1/1984 Wang et al.
4,429,244 A 1/1984 Nikitin et al.
4,431,960 A 2/1984 Zucker
4,432,029 A 2/1984 Lundqvist
4,437,464 A 3/1984 Crow
4,443,725 A 4/1984 Derderian et al.
4,470,884 A 9/1984 Carr
4,473,765 A 9/1984 Butman, Jr. et al.
4,475,075 A 10/1984 Munn
4,477,690 A 10/1984 Nikitin et al.
4,481,438 A 11/1984 Keim
4,484,106 A 11/1984 Taylor et al.
4,488,079 A 12/1984 Dailey et al.
4,490,651 A 12/1984 Taylor et al.
4,503,284 A 3/1985 Minnick et al.
4,508,251 A 4/1985 Harada et al.
4,510,077 A 4/1985 Elton
4,517,471 A 5/1985 Sachs
4,520,287 A 5/1985 Wang et al.
4,523,249 A 6/1985 Arimoto
4,538,131 A 8/1985 Baier et al.
4,546,210 A 10/1985 Akiba et al.
4,551,780 A 11/1985 Canay
4,552,990 A 11/1985 Persson et al.
4,557,038 A 12/1985 Wcislo et al.
4,560,896 A 12/1985 Vogt et al.
4,565,929 A 1/1986 Baskin et al.
4,571,453 A 2/1986 Takaoka et al.
4,588,916 A 5/1986 Lis
4,590,416 A 5/1986 Porche et al.
4,594,630 A 6/1986 Rabinowitz et al.
4,607,183 A 8/1986 Rieber et al.
4,615,109 A 10/1986 Wcislo et al.
4,615,778 A 10/1986 Elton
4,618,795 A 10/1986 Cooper et al.
4,619,040 A 10/1986 Wang et al.
4,622,116 A 11/1986 Elton et al.
4,633,109 A 12/1986 Feigel
4,650,924 A 3/1987 Kauffman et al.
4,652,963 A 3/1987 Fahlen
4,656,316 A 4/1987 Meltsch
4,656,379 A 4/1987 McCarty
4,663,603 A 5/1987 van Riemsdijk et al.
4,677,328 A 6/1987 Kumakura
4,687,882 A 8/1987 Stone et al.
4,692,731 A 9/1987 Osinga
4,723,083 A 2/1988 Elton
4,723,104 A 2/1988 Rohatyn
4,724,345 A 2/1988 Elton et al.
4,732,412 A 3/1988 van der Linden et al.
4,737,704 A 4/1988 Kalinnikov et al.
4,745,314 A 5/1988 Nakano
4,761,602 A 8/1988 Leibovich
4,766,365 A 8/1988 Bolduc et al.
4,771,168 A 9/1988 Gundersen et al.
4,785,138 A 11/1988 Breitenbach et al.
4,795,933 A 1/1989 Sakai
4,827,172 A 5/1989 Kobayashi
4,845,308 A 7/1989 Womack, Jr. et al.
4,847,747 A 7/1989 Abbondanti
4,853,565 A 8/1989 Elton et al.
4,859,810 A 8/1989 Cloetens et al.
4,859,989 A 8/1989 McPherson
4,860,430 A 8/1989 Raschbichler et al.
4,864,266 A 9/1989 Feather et al.
4,883,230 A 11/1989 Lindstrom
4,890,040 A 12/1989 Gundersen
4,894,284 A 1/1990 Yamanouchi et al.
4,914,386 A 4/1990 Zocholl
4,918,347 A 4/1990 Takaba
4,918,835 A 4/1990 Raschbichler et al.
4,924,342 A 5/1990 Lee
4,926,079 A 5/1990 Niemela et al.
4,942,326 A 7/1990 Butler, III et al.
4,949,001 A 8/1990 Campbell
4,982,147 A 1/1991 Lauw
4,994,952 A 2/1991 Silva et al.
4,997,995 A 3/1991 Simmons et al.
5,012,125 A 4/1991 Conway
5,030,813 A 7/1991 Stanisz
5,036,165 A 7/1991 Elton et al.
5,036,238 A 7/1991 Tajima
5,066,881 A 11/1991 Elton et al.
5,067,046 A 11/1991 Elton et al.
5,083,360 A 1/1992 Valencic et al.
5,086,246 A 2/1992 Dymond et al.
5,091,609 A 2/1992 Swada et al.
5,094,703 A 3/1992 Takaoka et al.
5,095,175 A 3/1992 Yoshida et al.
5,097,241 A 3/1992 Smith et al.
5,097,591 A 3/1992 Wcislo et al.
5,111,095 A 5/1992 Hendershot
5,124,607 A 6/1992 Rieber et al.
5,136,459 A 8/1992 Fararooy
5,140,290 A 8/1992 Dersch
5,153,460 A 10/1992 Bovino et al.

| | | | | |
|---|---|---|---|---|
| 5,168,662 | A | | 12/1992 | Nakamura et al. |
| 5,171,941 | A | | 12/1992 | Shimizu et al. |
| 5,175,396 | A | | 12/1992 | Emery et al. |
| 5,182,537 | A | | 1/1993 | Thuis |
| 5,187,428 | A | | 2/1993 | Hutchison et al. |
| 5,231,249 | A | | 7/1993 | Kimura et al. |
| 5,235,488 | A | | 8/1993 | Koch |
| 5,246,783 | A | | 9/1993 | Spenadel et al. |
| 5,264,778 | A | | 11/1993 | Kimmel et al. |
| 5,287,262 | A | | 2/1994 | Klein |
| 5,293,146 | A | | 3/1994 | Aosaki et al. |
| 5,304,883 | A | | 4/1994 | Denk |
| 5,305,961 | A | | 4/1994 | Errard et al. |
| 5,321,308 | A | | 6/1994 | Johncock |
| 5,323,330 | A | | 6/1994 | Asplund et al. |
| 5,325,008 | A | | 6/1994 | Grant |
| 5,325,259 | A | | 6/1994 | Paulsson |
| 5,327,637 | A | | 7/1994 | Breitenbach et al. |
| 5,341,281 | A | | 8/1994 | Skibinski |
| 5,343,139 | A | | 8/1994 | Gyugyi et al. |
| 5,355,046 | A | | 10/1994 | Weigelt |
| 5,365,132 | A | | 11/1994 | Hann et al. |
| 5,387,890 | A | | 2/1995 | Estop et al. |
| 5,397,513 | A | | 3/1995 | Steketee, Jr. |
| 5,399,941 | A | | 3/1995 | Grothaus et al. |
| 5,400,005 | A | | 3/1995 | Bobry |
| 5,408,169 | A | | 4/1995 | Jeanneret |
| 5,430,274 | A | * | 7/1995 | Couffet et al. ..... 219/677 |
| 5,442,131 | A | * | 8/1995 | Borgwarth ..... 174/15.6 |
| 5,449,861 | A | | 9/1995 | Fujino et al. |
| 5,452,170 | A | | 9/1995 | Ohde et al. |
| 5,461,215 | A | * | 10/1995 | Haldeman ..... 219/677 |
| 5,468,916 | A | | 11/1995 | Litenas et al. |
| 5,499,178 | A | | 3/1996 | Mohan |
| 5,500,632 | A | | 3/1996 | Halser, III |
| 5,510,942 | A | | 4/1996 | Bock et al. |
| 5,530,307 | A | | 6/1996 | Horst |
| 5,533,658 | A | | 7/1996 | Benedict et al. |
| 5,534,754 | A | | 7/1996 | Poumey |
| 5,545,853 | A | | 8/1996 | Hildreth |
| 5,550,410 | A | | 8/1996 | Titus |
| 5,583,387 | A | | 12/1996 | Takeuchi et al. |
| 5,587,126 | A | | 12/1996 | Steketee, Jr. |
| 5,591,937 | A | * | 1/1997 | Woody et al. ..... 174/5 R |
| 5,598,137 | A | | 1/1997 | Alber et al. |
| 5,607,320 | A | | 3/1997 | Wright |
| 5,612,510 | A | | 3/1997 | Hildreth |
| 5,663,605 | A | | 9/1997 | Evans et al. |
| 5,672,926 | A | | 9/1997 | Brandes et al. |
| 5,689,223 | A | | 11/1997 | Demarmels et al. |
| 5,807,447 | A | | 9/1998 | Forrest |
| 5,834,699 | A | | 11/1998 | Buck et al. |

FOREIGN PATENT DOCUMENTS

| | | |
|---|---|---|
| CH | 539328 | 7/1973 |
| CH | 646403 | 2/1979 |
| CH | 657482 | 8/1986 |
| CH | SU 1189322 | 10/1986 |
| DE | 40414 | 8/1887 |
| DE | 277012 | 7/1914 |
| DE | 336418 | 6/1920 |
| DE | 372390 | 3/1923 |
| DE | 386561 | 12/1923 |
| DE | 387973 | 1/1924 |
| DE | 406371 | 11/1924 |
| DE | 425551 | 2/1926 |
| DE | 426793 | 3/1926 |
| DE | 432169 | 7/1926 |
| DE | 433749 | 9/1926 |
| DE | 435608 | 10/1926 |
| DE | 435609 | 10/1926 |
| DE | 441717 | 3/1927 |
| DE | 443011 | 4/1927 |
| DE | 460124 | 5/1928 |
| DE | 482506 | 9/1929 |
| DE | 501181 | 7/1930 |
| DE | 523047 | 4/1931 |
| DE | 568508 | 1/1933 |
| DE | 572030 | 3/1933 |
| DE | 584639 | 9/1933 |
| DE | 586121 | 10/1933 |
| DE | 604972 | 11/1934 |
| DE | 629301 | 4/1936 |
| DE | 673545 | 3/1939 |
| DE | 719009 | 3/1942 |
| DE | 846583 | 8/1952 |
| DE | 875227 | 4/1953 |
| DE | 975999 | 1/1963 |
| DE | 1465719 | 5/1969 |
| DE | 1807391 | 5/1970 |
| DE | 2050674 | 5/1971 |
| DE | 1638176 | 6/1971 |
| DE | 2155371 | 5/1973 |
| DE | 2400698 | 7/1975 |
| DE | 2520511 | 11/1976 |
| DE | 2656389 | 6/1978 |
| DE | 2721905 | 11/1978 |
| DE | 137164 | 8/1979 |
| DE | 138840 | 11/1979 |
| DE | 2824951 | 12/1979 |
| DE | 2835386 | 2/1980 |
| DE | 2839517 | 3/1980 |
| DE | 2854520 | 6/1980 |
| DE | 3009102 | 9/1980 |
| DE | 2913697 | 10/1980 |
| DE | 2920478 | 12/1980 |
| DE | 3028777 | 3/1981 |
| DE | 2939004 | 4/1981 |
| DE | 3006382 | 8/1981 |
| DE | 3008818 | 9/1981 |
| DE | 209213 | 4/1984 |
| DE | 3305225 | 8/1984 |
| DE | 3309051 | 9/1984 |
| DE | 3441311 | 5/1986 |
| DE | 3543106 | 6/1987 |
| DE | 2917717 | 8/1987 |
| DE | 3612112 | 10/1987 |
| DE | 3726346 | 2/1989 |
| DE | 3925337 | 2/1991 |
| DE | 4023903 | 11/1991 |
| DE | 4022476 | 1/1992 |
| DE | 4233558 | 3/1994 |
| DE | 4402184 | 8/1995 |
| DE | 4409794 | 8/1995 |
| DE | 4412761 | 10/1995 |
| DE | 4420322 | 12/1995 |
| DE | 19620906 | 1/1996 |
| DE | 4438186 | 5/1996 |
| DE | 19020222 | 3/1997 |
| DE | 19547229 | 6/1997 |
| DE | 468827 | 7/1997 |
| DE | 134022 | 12/2001 |
| EP | 049104 | 4/1982 |
| EP | 0493704 | 4/1982 |
| EP | 0056580 A1 | 7/1982 |
| EP | 078908 | 5/1983 |
| EP | 0120154 | 10/1984 |
| EP | 0130124 | 1/1985 |
| EP | 0142813 | 5/1985 |
| EP | 0155405 | 9/1985 |
| EP | 00102513 | 1/1986 |
| EP | 0174783 | 3/1986 |

| | | | |
|---|---|---|---|
| EP | 0185788 | | 7/1986 |
| EP | 0277358 | | 8/1986 |
| EP | 0234521 | | 9/1987 |
| EP | 0244069 | | 11/1987 |
| EP | 0246377 | | 11/1987 |
| EP | 0265868 | | 5/1988 |
| EP | 0274691 | | 7/1988 |
| EP | 0280759 | | 9/1988 |
| EP | 0282876 | | 9/1988 |
| EP | 0309096 | | 3/1989 |
| EP | 0314860 | | 5/1989 |
| EP | 0316911 | | 5/1989 |
| EP | 0317248 | | 5/1989 |
| EP | 0335430 | | 10/1989 |
| EP | 0342554 | | 11/1989 |
| EP | 0221404 | | 5/1990 |
| EP | 0375101 | | 6/1990 |
| EP | 0406437 | | 1/1991 |
| EP | 0439410 | | 7/1991 |
| EP | 0440865 | | 8/1991 |
| EP | 0469155 | A1 | 2/1992 |
| EP | 0490705 | | 6/1992 |
| EP | 0503817 | | 9/1992 |
| EP | 0571155 | | 11/1993 |
| EP | 0620570 | | 10/1994 |
| EP | 0620630 | | 10/1994 |
| EP | 0642027 | | 3/1995 |
| EP | 0671632 | | 9/1995 |
| EP | 0676777 | | 10/1995 |
| EP | 0677915 | | 10/1995 |
| EP | 0684679 | | 11/1995 |
| EP | 0684682 | | 11/1995 |
| EP | 0695019 | | 1/1996 |
| EP | 0732787 | | 9/1996 |
| EP | 0738034 | | 10/1996 |
| EP | 0739087 | A2 | 10/1996 |
| EP | 0740315 | | 10/1996 |
| EP | 0749190 | A2 | 12/1996 |
| EP | 0751605 | | 1/1997 |
| EP | 0739087 | A3 | 3/1997 |
| EP | 0749193 | A3 | 3/1997 |
| EP | 0780926 | | 6/1997 |
| EP | 0802542 | | 10/1997 |
| EP | 0913912 | A1 | 5/1999 |
| FR | 805544 | | 4/1936 |
| FR | 841351 | | 1/1938 |
| FR | 847899 | | 12/1938 |
| FR | 916959 | | 12/1946 |
| FR | 1011924 | | 4/1949 |
| FR | 1126975 | | 3/1955 |
| FR | 1238795 | | 7/1959 |
| FR | 2251938 | | 6/1975 |
| FR | 2305879 | | 10/1976 |
| FR | 2376542 | | 7/1978 |
| FR | 2467502 | | 4/1981 |
| FR | 2481531 | | 10/1981 |
| FR | 2556146 | | 6/1985 |
| FR | 2594271 | | 8/1987 |
| FR | 2108171 | | 5/1992 |
| FR | 2708157 | | 1/1995 |
| GB | 268271 | | 3/1927 |
| GB | 293861 | | 11/1928 |
| GB | 292999 | | 4/1929 |
| GB | 319313 | | 7/1929 |
| GB | 518993 | | 3/1940 |
| GB | 537609 | | 6/1941 |
| GB | 540456 | | 10/1941 |
| GB | 589071 | | 6/1947 |
| GB | 666883 | | 2/1952 |
| GB | 685416 | | 1/1953 |
| GB | 702892 | | 1/1954 |
| GB | 715226 | | 9/1954 |
| GB | 723457 | | 2/1955 |
| GB | 739962 | | 11/1955 |
| GB | 763761 | | 12/1956 |
| GB | 805721 | | 12/1958 |
| GB | 827600 | | 2/1960 |
| GB | 854728 | | 11/1960 |
| GB | 870583 | | 6/1961 |
| GB | 913386 | | 12/1962 |
| GB | 965741 | | 8/1964 |
| GB | 992249 | | 5/1965 |
| GB | 1024583 | | 3/1966 |
| GB | 1053337 | | 12/1966 |
| GB | 1059123 | | 2/1967 |
| GB | 1103098 | | 2/1968 |
| GB | 1103099 | | 2/1968 |
| GB | 1117401 | | 6/1968 |
| GB | 1135242 | | 12/1968 |
| GB | 1147049 | | 4/1969 |
| GB | 1157885 | | 7/1969 |
| GB | 1174659 | | 12/1969 |
| GB | 1236082 | | 6/1971 |
| GB | 1268770 | | 3/1972 |
| GB | 1319257 | | 6/1973 |
| GB | 1322433 | | 7/1973 |
| GB | 1340983 | | 12/1973 |
| GB | 1341050 | | 12/1973 |
| GB | 1365191 | | 8/1974 |
| GB | 1395152 | | 5/1975 |
| GB | 1424982 | | 2/1976 |
| GB | 1426594 | | 3/1976 |
| GB | 1438610 | | 6/1976 |
| GB | 1445284 | | 8/1976 |
| GB | 1479904 | | 7/1977 |
| GB | 1493163 | | 11/1977 |
| GB | 1502938 | | 3/1978 |
| GB | 1525745 | | 9/1978 |
| GB | 2000625 | | 1/1979 |
| GB | 1548633 | | 7/1979 |
| GB | 2046142 | | 11/1979 |
| GB | 2022327 | | 12/1979 |
| GB | 2025150 | | 1/1980 |
| GB | 2034101 | | 5/1980 |
| GB | 1574796 | | 9/1980 |
| GB | 2070341 | | 9/1981 |
| GB | 2070470 | | 9/1981 |
| GB | 2071433 | | 9/1981 |
| GB | 2081523 | | 2/1982 |
| GB | 2099635 | | 12/1982 |
| GB | 2105925 | | 3/1983 |
| GB | 2106306 | | 4/1983 |
| GB | 2106721 | | 4/1983 |
| GB | 2136214 | | 9/1984 |
| GB | 2140195 | | 11/1984 |
| GB | 2150153 | | 6/1985 |
| GB | 2268337 | | 1/1994 |
| GB | 2273819 | | 6/1994 |
| GB | 2283133 | | 4/1995 |
| GB | 2289992 | | 12/1995 |
| GB | 2308490 | | 6/1997 |
| GB | 2332557 | | 6/1999 |
| GB | 123906 | | 11/2001 |
| HU | 175494 | | 11/1981 |
| JP | 60206121 | | 3/1959 |
| JP | 57043529 | | 8/1980 |
| JP | 57126117 | | 5/1982 |
| JP | 59076156 | | 10/1982 |
| JP | 59159642 | | 2/1983 |
| JP | 6264964 | | 9/1985 |
| JP | 1129737 | | 5/1989 |
| JP | 62320631 | | 6/1989 |

| | | |
|---|---|---|
| JP | 2017474 | 1/1990 |
| JP | 3245748 | 2/1990 |
| JP | 4179107 | 11/1990 |
| JP | 318253 | 1/1991 |
| JP | 424909 | 1/1992 |
| JP | 5290947 | 4/1992 |
| JP | 6196343 | 12/1992 |
| JP | 6233442 | 2/1993 |
| JP | 6325629 | 5/1993 |
| JP | 7057951 | 8/1993 |
| JP | 7264789 | 3/1994 |
| JP | 8167332 | 12/1994 |
| JP | 7161270 | 6/1995 |
| JP | 8264039 | 11/1995 |
| JP | 9200989 | 1/1996 |
| JP | 8036952 | 2/1996 |
| JP | 8167360 | 6/1996 |
| LU | 67199 | 3/1972 |
| SE | 90308 | 9/1937 |
| SE | 305899 | 11/1968 |
| SE | 255156 | 2/1969 |
| SE | 341428 | 12/1971 |
| SE | 453236 | 1/1982 |
| SE | 457792 | 6/1987 |
| SE | 502417 | 12/1993 |
| SU | 792302 | 1/1971 |
| SU | 425268 | 9/1974 |
| SU | 1019553 | 1/1980 |
| SU | 694939 | 1/1982 |
| SU | 955369 | 8/1983 |
| SU | 1511810 | 5/1987 |
| WO | WO8202617 | 8/1982 |
| WO | WO8502302 | 5/1985 |
| WO | WO9011389 | 10/1990 |
| WO | WO9012409 | 10/1990 |
| WO | PCT/DE 90/00279 | 11/1990 |
| WO | WO9101059 | 1/1991 |
| WO | WO9101585 | 2/1991 |
| WO | WO9107807 | 3/1991 |
| WO | PCT SE 91/00077 | 4/1991 |
| WO | WO9109442 | 6/1991 |
| WO | WO 91/11841 | 8/1991 |
| WO | WO8115862 | 10/1991 |
| WO | WO 91/15755 | 10/1991 |
| WO | WO9201328 | 1/1992 |
| WO | WO9203870 | 3/1992 |
| WO | WO9321681 | 10/1993 |
| WO | WO9406194 | 3/1994 |
| WO | WO9518058 | 7/1995 |
| WO | WO9522153 | 8/1995 |
| WO | 9522153 | 8/1995 |
| WO | WO9524049 | 9/1995 |
| WO | WO9622606 | 7/1996 |
| WO | WO9622607 | 7/1996 |
| WO | PCT/CN 96/00010 | 10/1996 |
| WO | WO9630144 | 10/1996 |
| WO | WO9710640 | 3/1997 |
| WO | WO9711831 | 4/1997 |
| WO | WO9716881 | 5/1997 |
| WO | WO 97/29494 | 8/1997 |
| WO | WO9745288 | 12/1997 |
| WO | WO9745847 | 12/1997 |
| WO | WO9745848 | 12/1997 |
| WO | WO9745906 | 12/1997 |
| WO | WO9745907 | 12/1997 |
| WO | WO 9745908 | 12/1997 |
| WO | WO9745912 | 12/1997 |
| WO | WO9745914 | 12/1997 |
| WO | WO9745915 | 12/1997 |
| WO | WO9745916 | 12/1997 |
| WO | WO9745918 | 12/1997 |
| WO | WO9745919 | 12/1997 |
| WO | WO9745920 | 12/1997 |
| WO | WO9745921 | 12/1997 |
| WO | WO9745922 | 12/1997 |
| WO | WO9745923 | 12/1997 |
| WO | WO9745924 | 12/1997 |
| WO | WO9745925 | 12/1997 |
| WO | WO9745926 | 12/1997 |
| WO | WO9745927 | 12/1997 |
| WO | WO9745928 | 12/1997 |
| WO | WO9745929 | 12/1997 |
| WO | WO9745930 | 12/1997 |
| WO | WO9745931 | 12/1997 |
| WO | WO9745932 | 12/1997 |
| WO | WO9745933 | 12/1997 |
| WO | WO9745934 | 12/1997 |
| WO | WO9745935 | 12/1997 |
| WO | WO9745936 | 12/1997 |
| WO | WO9745937 | 12/1997 |
| WO | WO9745938 | 12/1997 |
| WO | WO9745939 | 12/1997 |
| WO | WO9747067 | 12/1997 |
| WO | WO9820595 | 5/1998 |
| WO | WO9820596 | 5/1998 |
| WO | WO9820597 | 5/1998 |
| WO | WO 98/20598 | 5/1998 |
| WO | WO9820600 | 5/1998 |
| WO | WO 98/20602 | 5/1998 |
| WO | WO9821385 | 5/1998 |
| WO | PCT/FR 98/00468 | 6/1998 |
| WO | WO9827634 | 6/1998 |
| WO | WO9827635 | 6/1998 |
| WO | WO9827636 | 6/1998 |
| WO | WO9829927 | 7/1998 |
| WO | WO9829928 | 7/1998 |
| WO | WO9829929 | 7/1998 |
| WO | WO9829930 | 7/1998 |
| WO | WO9829931 | 7/1998 |
| WO | WO9829932 | 7/1998 |
| WO | WO9833731 | 8/1998 |
| WO | WO9833736 | 8/1998 |
| WO | WO9833737 | 8/1998 |
| WO | WO9834238 | 8/1998 |
| WO | WO 98/34239 | 8/1998 |
| WO | WO9834240 | 8/1998 |
| WO | WO9834241 | 8/1998 |
| WO | WO9834242 | 8/1998 |
| WO | WO9834243 | 8/1998 |
| WO | WO9834244 | 8/1998 |
| WO | WO9834245 | 8/1998 |
| WO | WO9834246 | 8/1998 |
| WO | WO9834247 | 8/1998 |
| WO | WO9834248 | 8/1998 |
| WO | WO9834249 | 8/1998 |
| WO | WO9834250 | 8/1998 |
| WO | WO9834309 | 8/1998 |
| WO | WO9834312 | 8/1998 |
| WO | WO9834315 | 8/1998 |
| WO | WO9834321 | 8/1998 |
| WO | WO9834322 | 8/1998 |
| WO | WO9834323 | 8/1998 |
| WO | WO9834325 | 8/1998 |
| WO | WO9834326 | 8/1998 |
| WO | WO9834327 | 8/1998 |
| WO | WO9834328 | 8/1998 |
| WO | WO9834329 | 8/1998 |
| WO | WO9834330 | 8/1998 |
| WO | WO9834331 | 8/1998 |
| WO | 9838657 | 9/1998 |
| WO | WO 98/40627 | 9/1998 |
| WO | WO 98/43336 | 10/1998 |

| | | |
|---|---|---|
| WO | WO9917309 | 4/1999 |
| WO | WO9917311 | 4/1999 |
| WO | WO9917312 | 4/1999 |
| WO | WO9917313 | 4/1999 |
| WO | WO9917314 | 4/1999 |
| WO | WO9917315 | 4/1999 |
| WO | WO9917316 | 4/1999 |
| WO | WO9917422 | 4/1999 |
| WO | WO9917424 | 4/1999 |
| WO | WO9917425 | 4/1999 |
| WO | WO9917426 | 4/1999 |
| WO | WO9917427 | 4/1999 |
| WO | WO9917428 | 4/1999 |
| WO | WO9917429 | 4/1999 |
| WO | WO9917432 | 4/1999 |
| WO | WO9917433 | 4/1999 |
| WO | WO9919963 | 4/1999 |
| WO | WO9919969 | 4/1999 |
| WO | WO9919970 | 4/1999 |
| WO | PCT/SE 98/02148 | 6/1999 |
| WO | WO9927546 | 6/1999 |
| WO | WO9928919 | 6/1999 |
| WO | WO9928921 | 6/1999 |
| WO | WO 99/28922 | 6/1999 |
| WO | WO9928923 | 6/1999 |
| WO | WO9928924 | 6/1999 |
| WO | WO9928925 | 6/1999 |
| WO | WO9928926 | 6/1999 |
| WO | WO9928927 | 6/1999 |
| WO | WO9928928 | 6/1999 |
| WO | WO9928929 | 6/1999 |
| WO | WO9928930 | 6/1999 |
| WO | WO9928931 | 6/1999 |
| WO | WO9928934 | 6/1999 |
| WO | WO9928994 | 6/1999 |
| WO | WO9929005 | 6/1999 |
| WO | WO 99/29005 | 6/1999 |
| WO | WO9929008 | 6/1999 |
| WO | WO9929011 | 6/1999 |
| WO | WO9929012 | 6/1999 |
| WO | WO9929013 | 6/1999 |
| WO | WO9929014 | 6/1999 |
| WO | WO9929015 | 6/1999 |
| WO | WO9929016 | 6/1999 |
| WO | WO9929017 | 6/1999 |
| WO | WO9929018 | 6/1999 |
| WO | WO9929019 | 6/1999 |
| WO | WO9929020 | 6/1999 |
| WO | WO9929021 | 6/1999 |
| WO | WO9929022 | 6/1999 |
| WO | WO 99/29023 | 6/1999 |
| WO | WO9929024 | 6/1999 |
| WO | WO 99/29025 | 6/1999 |
| WO | WO9929026 | 6/1999 |
| WO | WO9929029 | 6/1999 |
| WO | WO9929034 | 6/1999 |

OTHER PUBLICATIONS

Eine neue Type von Unterwassermotoren; Electrotechnik und Maschinebam, 49; Aug. 1931; pp2–3.

Problems in design of the 110–5OokV high–voltage generators; Nikiti et al; World Electrotechnical Congress; Jun. 21–27, 1977; Section 1. Paper #18.

Manufacture and Testing of Roebel bars; P. Marti et al.; 1960, Pub.86, vol. 8, pp 25–31.

Hydroalternators of 110 to 220 kV Elektrotechn. Obz., vol. 64, No. 3, pp132–136 Mar. 1975; A. Abramov.

Design Concepts for an Amorphous Metal Distribution Transformer; E. Boyd et al; IEEE Nov. 1984.

Neue Wege zum Bau zweipoliger Turbogeneratoren bis 2 GVA, 6OkV Elektrotechnik und Maschinenbau Wien Janner 1972, Heft 1, Seite 1–11; G. Aichholzer.

Optimizing designs of water–resistant magnet wire; V. Kuzenev et al; Elektrotekhnika, vol. 59, No. 12, pp35–40, 1988.

Zur Entwicklung der Tauchpumpenmotoren; A. Schanz; KSB, pp19–24.

Direct Generation of alternating current at high voltages; R. Parsons; IEEE Journal, vol. 67 #393, Jan. 15, 1929; pp1065–1080.

Stopfbachslose Umwalzpumpen– ein wichtiges Element im modernen Kraftwerkbau; H. Holz, KSB 1, pp13–19, 1960.

Zur Geschichte der Brown Boveri–Synchron–Maschinen; Vierzig Jahre Generatorbau; Jan.–Feb. 1931 pp15–39.

Technik und Anwendung moderner Tauchpumpen; A. Heumann; 1987.

High capacity synchronous generator having no tooth stator; V.S. Kildishev et al; No. 1, 1977 pp11–16.

Der Asynchronmotor als Antrieb stopfbcichsloser Pumpen; E. Picmaus; Eletrotechnik und Maschinenbay No. 78, pp153–155, 1961.

Low core loss rotating flux transformer; R. F. Krause, et al; American Institute Physics J.Appl.Phys vol. 64 #10 Nov. 1988, pp5376–5378.

An EHV bulk Power transmission line Made with Low Loss XLPE Cable;Ichihara et al; Aug. 1992; pp3–6.

Underground Transmission Systems Reference Book; 1992;pp16–19; pp36–45; pp67–81.

Power System Stability and Control; P. Kundur, 1994; pp23–25;p. 767.

Six phase Synchronous Machine with AC and DC Stator Connections, Part II:Harmonic Studies and a proposed Uninterruptible Power Supply Scheme; R. Schiferi et al.;Aug. 1983 pp 2694–2701.

Six phase Synchronous Machine with AC and DC Stator Connections, Part 1: Equivalent circuit representation and Steady–State Analysis; R. Schiferi et al; Aug. 1983; pp2685–2693.

Reactive Power Compensation; T. Petersson; 1993; pp 1–23.

Permanent Magnet Machines; K. Binns; 1987; pp 9–1 through 9–26.

Hochspannungsaniagen for Wechselstrom; 97. Hochspannungsaufgaben an Generatoren und Motoren; Roth et al; 1938; pp452–455.

Hochspannungsanlagen for Wechselstrom; 97. Hochspannungsaufgaben an Generatoren und Motoren; Roth et al; Spring 1959, pp30–33.

Neue Lbsungswege zum Entwurf grosser Turbogeneratoren bis 2GVA, 60kV; G. Aicholzer; Sep. 1974, pp249–255.

Advanced Turbine–generators– an assessment; A. Appleton, et al; International Conf. Proceedings, Lg HV Elec. Sys. Paris, FR, Aug.–Sep. 1976, vol. I, Section 11–02, p. 1–9.

Fully slotless turbogenerators; E. Spooner; Proc., IEEE vol. 120 #12, Dec. 1973.

Toroidal winding geometry for high voltage superconducting alternators; J. Kirtley et al; MIT—Elec. Power Sys. Engrg. Lab for IEEE PES;Feb. 1974.

High–Voltage Stator Winding Development; D. Albright et al; Proj. Report EL339, Project 1716, Apr. 1984.

POWERFORMER ™: A giant step in power plant engineering; Owman et al; CIGRE 1998, Paper 11:1.1.

Thin Type DC/DC Converter using a coreless wire transformer; K. Onda et al; Proc. IEEE Power Electronics Spec. Conf.; Jun. 1994, pp330–334.
Develpment of extruded polymer insulated superconducting cable; Jan. 1992.
Transformer core losses; B. Richardson; Proc. IEEE May 1986, pp365–368.
Cloth–transformer with divided windings and tension annealed amorphous wire; T. Yammamoto et al; IEEE Translation Journal on Magnetics in Japan vol. 4, No. 9 Sep. 1989.
A study of equipment sizes and constraints for a unified power flow controller; J Bian et al; IEEE 1996.
A test installation of a self–tuned ac filter in the Konti–Skan 2 HVDC link; T. Holmgren,G. Asplund, S. Valdemarsson, P. Hidman of ABB; U. Jonsson of Svenska Kraftnat; O. loof of Vattenfall Vastsverige AB; IEEE Stockholm Power Tech Conference Jun. 1995, pp 64–70.
Analysis of faulted Power Systems; P Anderson, Iowa State University Press / Ames, Iowa, 1973, pp 255–257.
36–Kv. Generators Arise from Insulation Research; P. Sidler; *Electrical World* Oct. 15, 1932, ppp 524.
Oil Water cooled 300 MW turbine generator;L.P. Gnedin et al;*Elektrotechnika* , 1970, pp 6–8.
J&P Transformer Book 11$^{th}$ Edition;A. C. Franklin et al; owned by Butterworth—Heinemann Ltd, Oxford Printed by Hartnolls Ltd in Great Britain 1983, pp29–67.
Transformerboard; H.P. Moser et al; 1979, pp 1–19.
The Skagerrak transmission—the world's longest HVDC submarine cable link; L. Haglof et al of ASEA; ASEA Journal vol. 53, No. 1–2, 1980, pp 3–12.
Direct Connection of Generators to HVDC Converters: Main Characteristics and Comparative Advantages; J.Arrillaga et al; *Electra* No. 149, Aug. 1993, pp 19–37.
Our flexible friend article; M. Judge; *New Scientist*, May 10, 1997, pp 44–48.
In–Service Performance of HVDC Converter transformers and oil–cooled smoothing reactors; G.L. Desilets et al; *Electra* No. 155, Aug. 1994, pp 7–29.
Transformateurs a courant continu haute tension–examen des specifications; A. Lindroth et al; *Electra* No. 141, Apr. 1992, pp 34–39.
Development of a Termination for the 77 kV–Class High Tc Superconducting Power Cable; T. Shimonosono et al; IEEE Power Delivery, vol. 12, No. 1, Jan. 1997, pp 33–38.
Verification of Limiter Performance in Modern Excitation Control Systems; G. K. Girgis et al; IEEE Energy Conservation, vol. 10, No. 3, Sep. 1995, pp 538–542.
A High Initial response Brushless Excitation System; T. L. Dillman et al; IEEE Power Generation Winter Meeting Proceedings, Jan. 31, 1971, pp 2089–2094.
Design, manufacturing and cold test of a superconducting coil and its cryostat for SMES applications; A. Bautista et al; IEEE Applied Superconductivity, vol. 7, No. 2, Jun. 1997, pp 853–856.
Quench Protection and Stagnant Normal Zones in a Large Cryostable SMES; Y. Lvovsky et al; IEEE Applied Superconductivity, vol. 7, No. 2, Jun. 1997, pp 857–860.
Design and Construction of the 4 Tesla Background Coil for the Navy SMES Cable Test Apparatus; D.W.Scherbarth et al; IEEE Applied Superconductivity, vol. 7, No. 2, Jun. 1997, pp 840–843.
High Speed Synchronous Motors Adjustable Speed Drives; ASEA Generation Pamphlet OG 135–101 E, Jan. 1985, pp 1–4.
Billig burk motar overtonen; A. Felldin; *ERA* (TEKNIK) Aug. 1994, pp 26–28.
400–kV XLPE cable system passes CIGRE test; ABB Article; ABB Review Sep. 1995, pp 38.
FREQSYN—a new drive system for high power applications;J–A. Bergman et al; ASEA Journal 59, Apr. 1986, pp16–19.
Canadians Create Conductive Concrete; J. Beaudoin et al; *Science*, vol. 276, May 23, 1997, pp 1201.
Fully Water–Cooled 190 MVA Generators in the Tonstad Hydroelectric Power Station; E. Ostby et al; BBC Review Aug. 1969, pp 380–385.
Relocatable static var compensators help control unbundled power flows; R. C. Knight et al; *Transmission & Distribution*, Dec. 1996, pp 49–54.
Investigation and Use of Asynchronized Machines in Power Systems*; N.I.Blotskii et al; *Elektrichestvo*, No. 12, 1–6, 1985, pp 90–99.
Variable–speed switched reluctance motors; P.J. Lawrenson et al; IEE proc, vol. 127, Pt.B, No. 4, Jul. 1980, pp 253–265.
Las Einphasenwechselstromsystem hoherer Frequenz; J.G. Heft; Elektirsche Bahnen eb; Dec. 1987, pp. 388–389.
Power Transmission by Direct Current; E. Uhlmann; ISBN 3–540–07122–9 Springer–Verlag, Berlin/Heidelberg/New York; 1975, pp. 327–328.
Elektriska Maskiner; F. Gustavson; Institute for Elkreafteknilk, KTH; Stockholm, 1996, pp. 3–6 –3–12.
Die Wechselstromtechnik; A. Cour'Springer Vertag, Germany; 1936, pp. 586–598.
Insulation systems for superconducting transmission cables; O. Toennesen; Nordic Insulation Symposium, Bergen, 1996, pp. 425–432.
MPTC: An economical alternative to universal power flow controllers; N. Mohan; EPE 1997, Trondheim, pp. 3.1027–3.1030.
Lexikon der Technik; Luger; Band 2, Grundlagen der Elektrotechnik und Kerntechnik, 1960, pp. 395.
Das Handbuch der Lokomotiven (hungarian locomotive V40 1 'D'); B. Hollingsworth et al; Pawlak Verlagsgesellschaft; 1933, pp. 254–255.
Synchronous machines with single or double 3–phase star–connected winding fed by 12–pulse load commutated inverter. Simulation of operational behaviour; C. Ivarson et al; ICEM 1994, International Conference on electrial machines, vol. 1, pp. 267–272.
Elkrafthandbroken, Elmaskiner; A Rejminger; Elkrafthandbroken, Elmaskiner 1996, 15–20.
Power Electronics –in Theory and Practice; K. Thorborg; ISBN 0–86238–341–2, 1993, pp. 1–13.
Regulating transformers in power systems–new concepts and applications; E. Wirth et al; ABB Review Apr. 1999, p. 12–20.
Tranforming transfromers; S. Mehta et al; *IEEE Spectrum,* Jul. 1997, pp. 43–49.
A Study of equipment sizes and constraints for a unified power flow controller; J. Bian et al; IEEE Transactions on Power Delivery, vol. 12, No. 3, Jul. 1997, pp. 1385–1391.
Industrial High Voltage; F.H. Kreuger; *Industrial High Voltage* 1991 vol. 1, pp. 113–117.
Hochspannungstechnik; A. Küchler; Hochspannungstechnik, VDI Verlag 1996, pp. 365–366, ISBN 3–18–401530–0 or 3–540–62070–2.

High Voltage Engineering; N.S. Naidu; High Voltage Engineering, second edition 1995 ISBN 0–07–462286–2, Chapter 5, pp. 91–98.
Performance Characteristics of a Wide Range Induction Type Frequency Converter; G.A. Ghoneem; Ieema Journal, Sep. 1995, pp. 21–34.
International Electrotechnical Vocabulary, Chapter 551 Power Electronics; unknown author; International Electrotechnical Vocabulary Chapter 551: Power Electronics Bureau Central de la Commission Electrotechnique Internationale, Geneve; 1982, pp. 1–65.
Design and manufacture of a large superconducting homopolar motor; A.D. Appleton; IEEE Transaction on Magnetics, vol. 19, No. 3, Part 2, May 1983, pp. 1048–1050.
Application of high temperature superconductivy to electric motor design; J.S. Edmonds et al; IEEE Transactions on Energy Conversion Jun. 1992, No. 2, pp. 322–329.
Power Electronics and Variable Frequency Drives; B. Bimal; IEEE industrial Electronics–Technology and Applications, 1996, pp. 356.
Properties of High Plymer Cement Mortar; M. Tamal et al; *Science & Technology in Japan,* No. 63; 1977, pp. 6–14.

Weatherbility of Polymer–Modified Mortars after Ten–Year Outdoor Exposure in Koriyama and Sapporo; Y. Ohama et al; *Science & Technology in Japan* No. 63; 1977, pp. 26–31.

SMC Powders Open New Magnetic Applications; M. Persson (Editor); *SMC Update,* vol. 1, No. 1, Apr. 1997.

Characteristics of a laser triggered spark gap using air, Ar, CH4,H2, He, N2, SF6 and Xe; W.D. Kimura et al; Journal of Applied Physics, Vol. 63, No. 6, Mar. 15, 1988, p. 1882–1888.

Low–intensy laser–triggering of rail–gaps with magnesium–aerosol switching–gases; W. Frey; 11th International Pulse Power Conference, 1997, Baltimore, USA Digest of Technical Papers, p. 322–327.

* cited by examiner

STATIONARY INDUCTION MACHINE AND A CABLE THEREFOR

TECHNICAL FIELD

The present invention relates to a stationary induction machine including at least one winding including at least one elongate, flexible cable having an electric lead, and a cooling device arranged, with the aid of a coolant, to divert excess heat generated in the lead during operation of the induction machine, where the lead is in the form of a tube and surrounds a continuous channel for the circulation of said coolant.

The invention also relates to a cable for such an induction machine.

The present invention especially relates to a stationary induction machine, and a cable for such, for system voltages exceeding 1 kilovolt.

In this context, "cable" denotes an electric lead surrounded by a fixed, continuous insulating material.

BACKGROUND ART

In electric power systems for transmitting electric energy, it is known to use stationary induction machines with windings comprising cables. "Electric power systems" here denotes systems for voltages exceeding 1 kilovolt and "stationary induction machines" here denotes non-rotating induction machines, i.e. transformers and reactors.

A problem with the known cable-wound induction machines, especially in applications where large currents occur, is the difficulty of efficiently diverting the excess heat generated during operation because of Joule-effect losses in the lead of the cable. "Excess heat" here denotes the heat that causes the temperature in the induction machine to exceed a predetermined temperature, which is higher than the ambient temperature. A known method of providing cooling is to create flow paths, in which a coolant is induced to flow, between the winding turns. Usually, the cooling is forced, i.e. the coolant is induced to flow with the aid of a pump or a fan device.

In the cooling arrangement known through WO 98/34239 A1, the winding is designed with spacing elements that separate predetermined adjoining winding turns from each other. Flow paths in which a fan device induces a gas to flow, usually air, are thus created in the winding. In this context, hoods are commonly used to guide the gas stream into the winding. However, the above-mentioned cooling arrangements exhibit a number of drawbacks. First, placing the flow paths between adjoining winding turns means that the winding occupies a relatively large volume. This makes the induction machine relatively large, which in certain applications can be disadvantageous, for instance in transformers where a high filling factor in the winding is desired. The hoods, which guide the air stream into the winding, also contribute significantly to the size of the induction machine and, moreover, make the induction machine expensive to manufacture. Secondly, the flow paths constitute impairments in the winding, as adjoining winding turns separated by a flow path do not support each other. These impairments can make the winding sensitive to the forces that arise during short circuits in the electric power system. Thirdly, the present trend of development is towards ever-higher currents in the induction machines, which requires an ever-higher flow velocity for the coolant in gas-cooled induction machines to provide sufficiently effective cooling. This entails a large consumption of energy in the fan device.

In another known cooling arrangement, flow paths are created in the form of cooling tubes of an electrically insulating material, usually a polymer material, which cooling tubes extend through the winding between the winding turns. A pumping device pumps a liquid, such as de-ionized water, through the tubes. However, such arrangements cooled by liquid exhibit the same drawbacks as the arrangements cooled by gas described above, as the flow paths increase the volume of the winding and reduce its capacity to withstand short-circuit forces. In addition, a further problem arises. The permeability to liquids, at least to a limited extent, of polymer materials poses a risk of the cooling liquid permeating through the cooling tube and into the insulating layer surrounding the lead in the cable. The cooling liquid, in combination with the electrical alternating field that arises around the lead when an alternating current runs through the same during operation, can form so-called water trees in the insulating layer. This is undesirable, as the formation of water trees weakens the electrical insulating strength of the insulating layer. The formation of water trees can also occur in the cooling tubes, which is not desirable either.

Another cooling arrangement is known through GB 2332557 A, which describes a power cable for high-voltage induction apparatus. The power cable comprises an inner support or cooling tube of metal, through which a coolant flows. The aim is to cool the power cable to cryostatic temperatures and the cooling tube in question consists of metal, for instance an alloy of copper and nickel.

A cable-wound induction machine with a cooling tube of conducting material wound with the cable displays a great disadvantage, however. The disadvantage is that the magnetic flux in the induction machine induces electric currents in the cooling tube. This results in the cooling tube being heated and undesired losses arising. This problem increases with the frequency and the rated output of the electric power system in which the induction machine operates.

DESCRIPTION OF THE INVENTION

The object of the present invention is to provide a stationary induction machine with a new cooling device that completely or partially overcomes the above-mentioned drawbacks and problems.

The induction machine and the cable in accordance with the invention are characterized in that the cable includes a cooling tube of a polymer material that is arranged in the lead and forms said channel.

Efficient cooling is provided by the channel being arranged inside the lead in that the coolant acts in the immediate vicinity of the heat source, i.e. the lead of the cable. The excess heat does not have to permeate through the insulating layer of the cable before said heat can be displaced by the coolant. Furthermore, the coolant acts in the area where temperature peaks, so-called "hot spots", normally occur in conventional cables, namely in the central part of the cable, which makes the cooling yet more efficient. Furthermore the channel, by being placed inside the lead, is not subjected to the electrical alternating field generated by the current in the lead. Thus, the problem involving the formation of water trees in the cooling tube is avoided. Besides, by the channel being placed inside the lead, adjoining winding turns can be placed in close proximity to each other, which enables a stable winding construction for good absorption of short-circuit forces.

Induced currents in the cooling tube are avoided by the cooling tube being of a polymer material. The losses in an induction machine in accordance with the invention are thereby considerably reduced, as compared with cable-wound induction machines where the cable has a cooling tube of a conducting material. In addition, as compared with metal, polymer materials are flexible, which provides an easily manipulated cable and consequent advantages in the formation of the winding.

BRIEF DESCRIPTION OF THE DRAWINGS

The invention will be explained further in the following with reference to the drawings, where.

DESCRIPTION OF EMBODIMENTS

Figure 1:
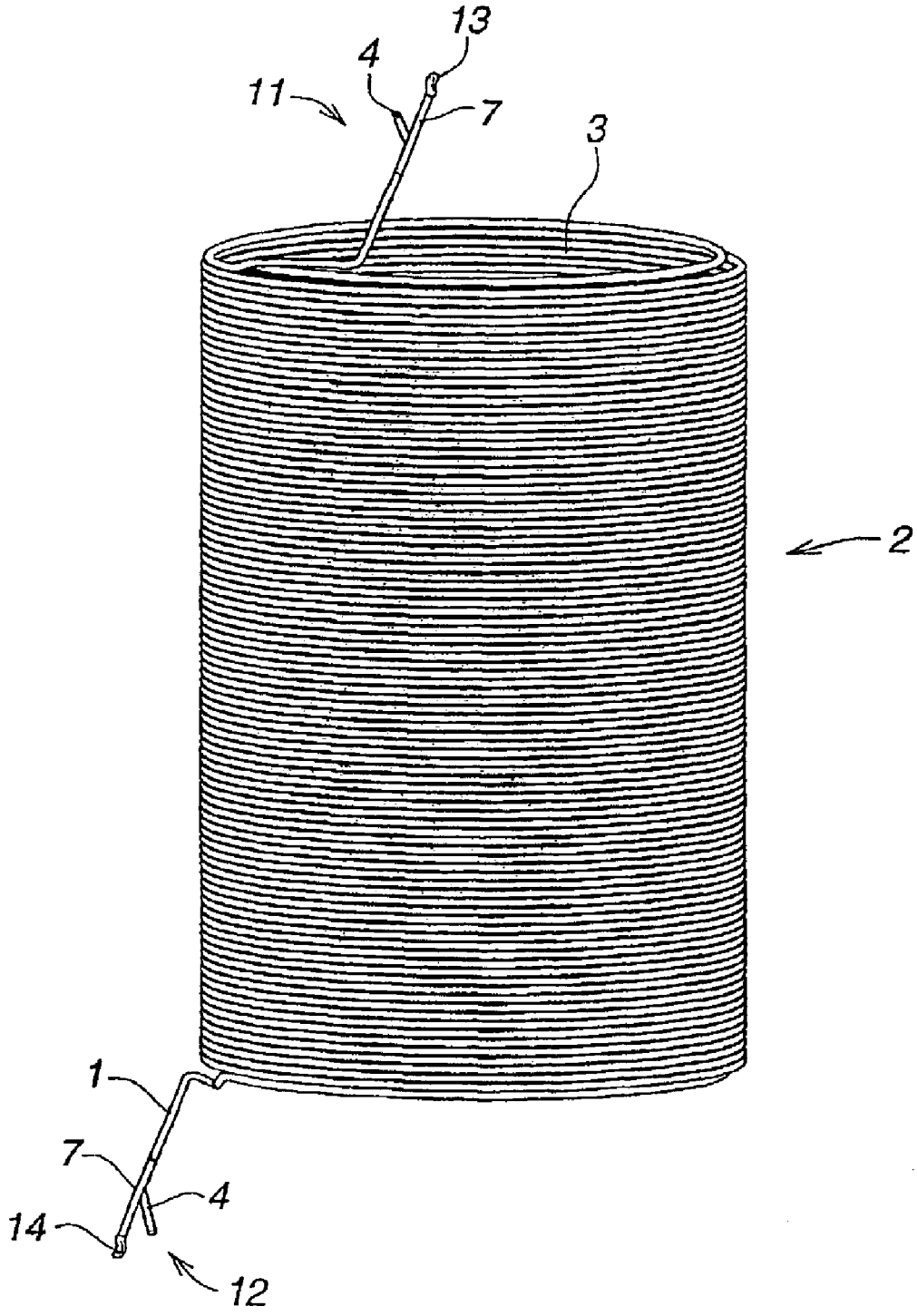
FIG. 1 shows schematically a cable-wound reactor.
Figure 2:
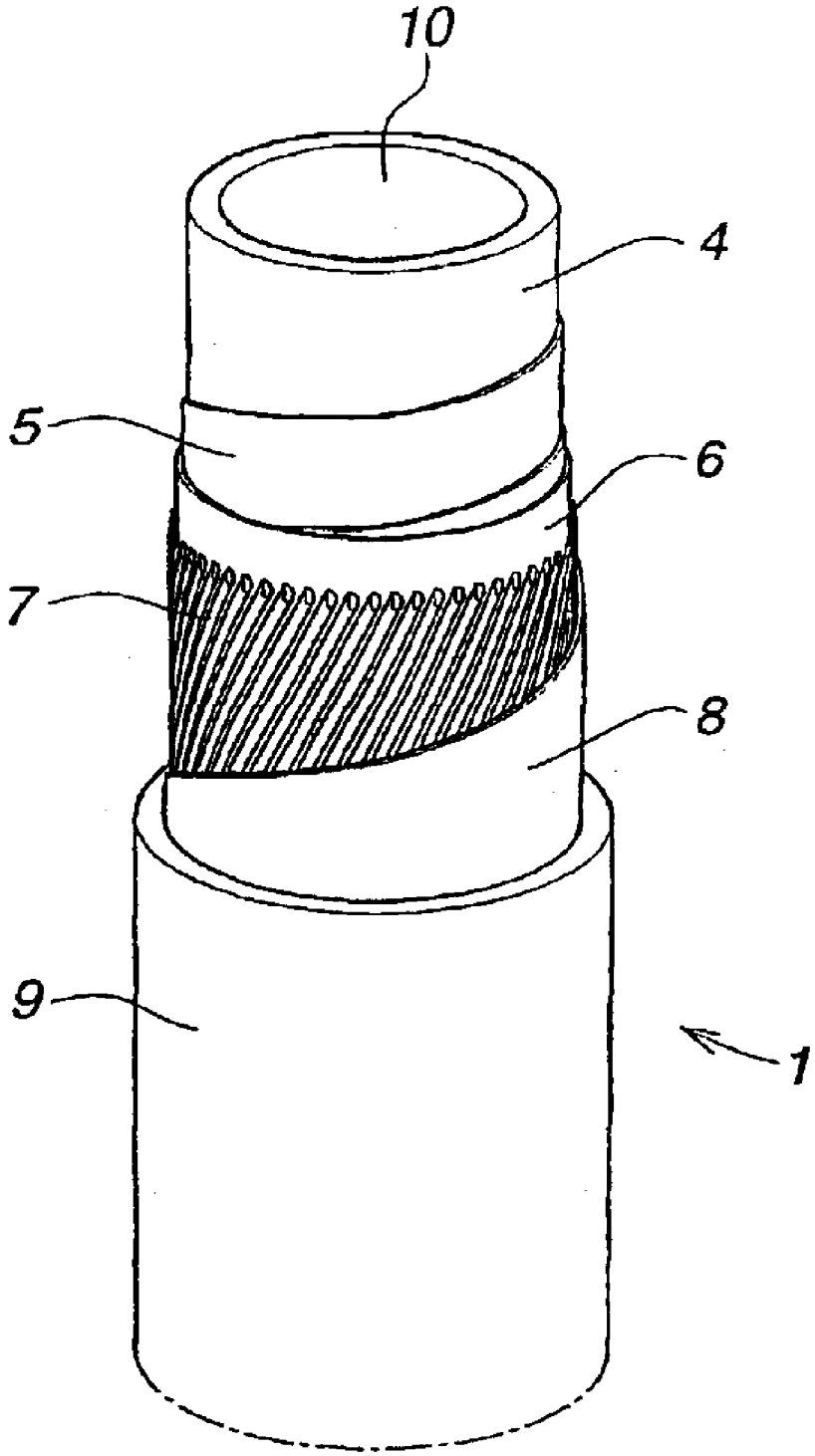
FIG. 2 shows a cut-away part of the cable that forms part of the reactor in accordance with FIG. 1.

FIG. 1 shows parts of a cable-wound stationary induction machine in the form of a reactor. The reactor is intended for connection between converters in a HVDC system (not shown) and a phase conductor in a HVAC system (not shown) to dampen the harmonics generated by the converters. The reactor comprises a support structure, not shown, carrying a cable 1 wound so that it forms a cylindrical winding 2, surrounding a central part 3 filled with air, which forms the air core of the reactor. In this connection, the cable 1 is arranged to carry an electric current to generate a magnetic flow in the air core 3. A cut-away part of the cable is shown in FIG. 2. The cable has a substantially circular cross-section and comprises an elongate, flexible cooling tube 4 arranged concentrically about its longitudinal axis, a diffusion layer 5 surrounding the cooling tube 4, a semiconducting layer 6 surrounding the diffusion layer 5, a lead 7 surrounding the semiconducting layer 6, a support layer 8 surrounding the lead 7 and, finally, an insulating layer 9 surrounding the support layer 8. The cooling tube 4 forms a channel 10 occupying the central part of the cable 1, in which channel 10 a coolant in the form of a mixture of glycol and water flows. The cooling tube 4 is made of a polymer material, preferably cross-linked polyethylene (XLPE). As polymer materials are permeable to liquids, at least to a limited extent, the diffusion layer 5 is arranged on the envelope surface of the tube to ensure that the glycol-water mixture does not permeate out into the outer parts of the cable 1 and cause the formation of water trees in the insulating layer 9. The diffusion layer 5 preferably consists of a polyethylene-laminated aluminium tape that is helically wound about the cooling tube 4, whereby a diffusion layer 5 is provided that is tight and in which only small electric currents are generated because of the magnetic flow in the air core 3 of the reactor. The semiconducting layer 6 arranged on the diffusion layer 5 consists of polyethylene mixed with pulverized coal, which forms the substructure for the lead 7 of the cable 1. The lead 7 is tubular. In the embodiment shown, it consists of a plurality of varnished aluminium wires disposed in close proximity to each other and wound in a layer on the semiconducting layer 6. The support layer 8 consists of a ribbon of polypropylene copolymer (PP copolymer), which is wound onto the lead 7 during manufacture of the cable 1 to prevent the polymer material of the insulating layer 9 from penetrating between the aluminium wires during the extrusion of the insulating layer 9 onto the cable 1. The insulating layer 9 preferably consists of XLPE.

Figure 3:
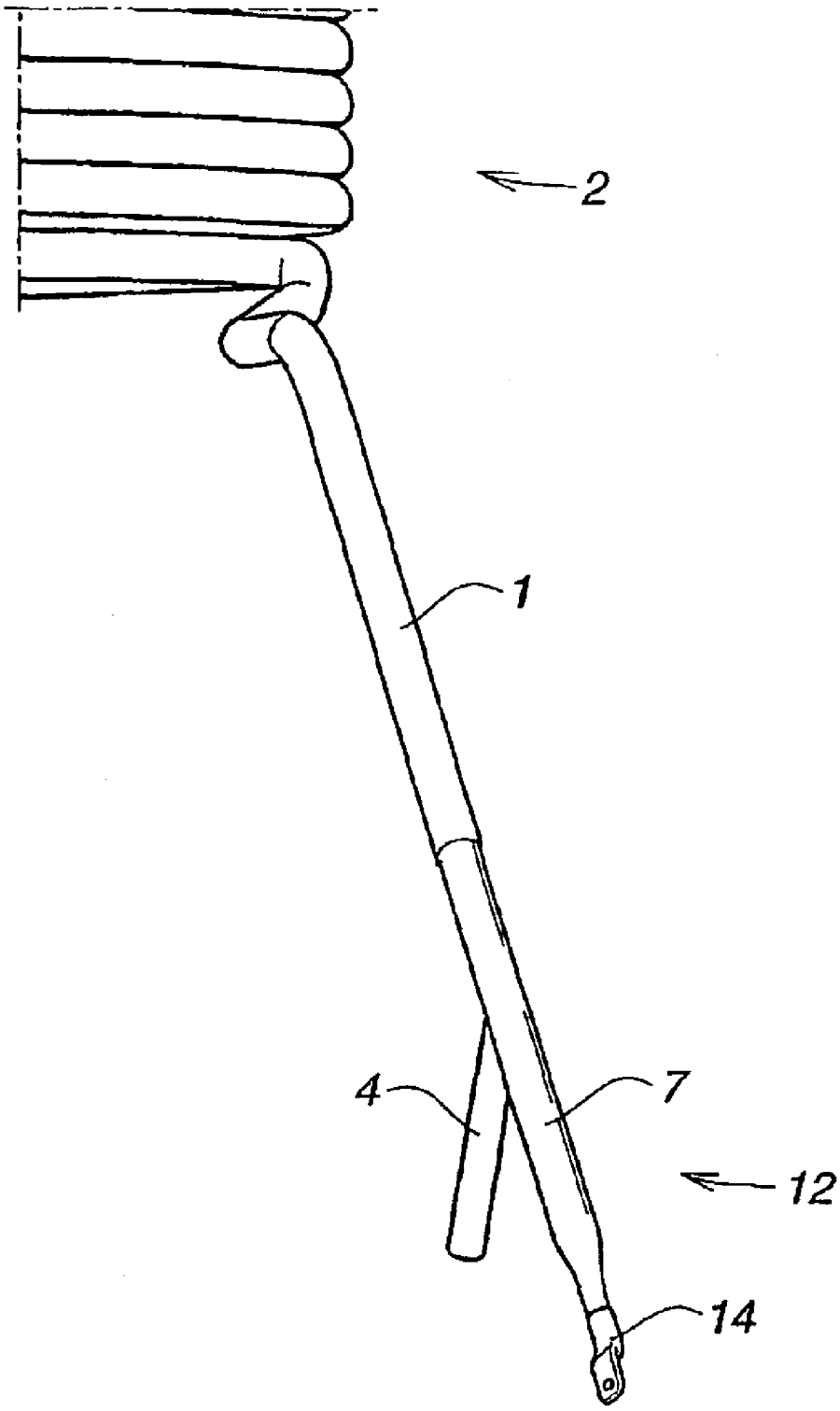
FIG. 3 shows an end part of the cable in accordance with FIG. 1.

The cable extends between two end parts 11, 12, each respectively located at one of the two opposing end surfaces of the helical winding 2. One of the end parts is shown in FIG. 3. The insulating layer 9 and the support layer 8 are removed from the cable 1 at the end parts 11, 12. The cooling tube 4, at each end part 11, 12, exits through an opening in the semiconducting layer 6 and the lead 7, together with the diffusion layer 5, and, at each end part 11, 12, is coupled up to a connection tube (not shown), which leads the mixture of glycol and water to a pumping and heat-exchanger device (not shown). The lead 7, after being separated from the cooling tube 4 at each end part 11, 12, is electrically coupled up to a connection coupling 13, 14, which connection couplings 13, 14 are connected to the converters (not shown) of the HVDC system and one of the phase conductors (not shown) of the HVAC system respectively.

The principle of the invention has been described above in relation to a cable-wound single-phase reactor with an air core. However, it should be understood that the invention is also applicable to other types of cable-wound, stationary induction machines, for instance, a cable-wound three-phase power transformer with an iron core.

In the above embodiment, the coolant is a mixture of glycol and water. However, in other applications, other coolants can be used, such as de-ionized water or a gaseous coolant, such as air. In certain applications, the diffusion layer can be omitted. However, it is of great importance that the constituent parts of the cable are flexible to allow supple forming of the cable during manufacture of the induction machine.

What is claimed is:

1. A stationary induction machine comprising:

at least one winding, including an elongate, flexible cable, having an electric lead; and a cooling device, arranged, with aid of a coolant, to divert excess heat generated in the lead during operation of the induction machine;

wherein the lead is in a form of a tube and surrounds a continuous channel for circulation of said coolant, and wherein the cable includes a cooling tube of a polymer material arranged in the lead and forming said channel.

2. An induction machine as claimed in claim 1, wherein the polymer material comprises cross-linked polyethylene.

3. An induction machine as claimed in claim 1, wherein a diffusion layer impermeable to the coolant is arranged on an envelope surface of the cooling tube.

4. An induction machine as claimed in claim 3, wherein the diffusion layer consists of polyethylene-laminated aluminum tape.

5. An induction machine as claimed in claim 1, wherein the coolant is a mixture of glycol and water.

6. An induction machine as claimed in claim 1, wherein the cable includes a fixed electrically insulating layer of a polymer material surrounding the lead.

7. An induction machine as claimed in claim 1, wherein the channel occupies a central part of the cable.

8. An elongate, flexible cable comprising:

an electric lead and a fixed electrically insulating layer of a polymer material surrounding the lead, which cable is configured to form a winding in a stationary induction machine, in which a cooling device is arranged, with aid of a coolant, to displace excess heat generated in the lead during operation of the induction machine, which lead is in a form of a tube and surrounds a continuous channel for circulation of said coolant, wherein the cable includes a cooling tube of polymer material arranged in the lead and forming said channel.

9. A cable as claimed in claim 8, wherein the polymer material comprises cross-linked polyethylene.

10. A cable as claimed in claim 8, wherein a diffusion layer impermeable to the coolant is arranged on an envelope surface of the cooling tube.

11. A cable as claimed in claim 8, wherein the channel occupies a central part of the cable.

* * * * *

UNITED STATES PATENT AND TRADEMARK OFFICE

CERTIFICATE OF CORRECTION

PATENT NO. : 7,045,704 B2
APPLICATION NO. : 10/258740
DATED : May 16, 2006
INVENTOR(S) : Areskoug It is certified that error appears in the above-identified patent and that said Letters Patent is hereby corrected as shown below:

-- (87) PCT Pub. No.: WO01/84571

PCT Pub. Date: Nov. 8, 2001 --

Signed and Sealed this

Twenty-ninth Day of August, 2006

JON W. DUDAS
*Director of the United States Patent and Trademark Office*